United States Patent [19]

Hennenfent et al.

[11] Patent Number: 4,536,992

[45] Date of Patent: Aug. 27, 1985

[54] PRECISION LAPPING SYSTEM

[75] Inventors: Douglas J. Hennenfent, New Hope; Allan L. Holmstrand, Bloomington; Alan G. Kracke, Minnetonka, all of Minn.

[73] Assignee: Magnetic Peripherals, Minneapolis, Minn.

[21] Appl. No.: 548,598

[22] Filed: Nov. 4, 1983

[51] Int. Cl.[3] ..... B24B 7/00

[52] U.S. Cl. ..... 51/109 R; 51/121; 51/124 R; 51/229

[58] Field of Search ..... 51/109 R, 121, 122, 51/124 R, 125.5, 229

[56] References Cited

U.S. PATENT DOCUMENTS

| | | | |
|---|---|---|---|
| 621,181 | 3/1899 | Thompson | 51/124 |
| 970,227 | 9/1910 | Homan | 51/109 R |
| 1,268,967 | 6/1918 | Hampton | 51/124 R |
| 1,331,480 | 2/1920 | Boerner | 51/229 |
| 1,798,639 | 3/1931 | Tvestmann | 51/124 R |
| 2,450,984 | 10/1948 | Pastore | 51/229 |
| 2,654,979 | 10/1953 | Grodzinski et al. | 51/229 |
| 2,821,051 | 1/1958 | Franz | 51/124 R |
| 3,110,136 | 11/1963 | Spira | 51/125 |
| 3,863,395 | 2/1975 | Brown | 51/121 |
| 3,921,340 | 11/1975 | Johnson et al. | 51/165 R |
| 4,014,141 | 3/1977 | Riddle et al. | 51/165 R |
| 4,062,659 | 12/1977 | Feierabend et al. | 51/281 R |
| 4,237,658 | 12/1980 | Stark | 51/229 |
| 4,246,727 | 1/1981 | Weissman | 51/121 |

OTHER PUBLICATIONS

IBM Tech. Disc. Bull., vol. 22, No. 12, p. 5434ff, May 1980, Manufacture of Air . . . Sliders.

*Primary Examiner*—Frederick R. Schmidt
*Assistant Examiner*—J. T. Zatarga
*Attorney, Agent, or Firm*—Edward L. Schwarz; Joseph A. Genovese

[57] ABSTRACT

Apparatus for precisely machining the surface of a workpiece comprises a rotating plate with a flat, horizontal abrasive-laden surface against which the workpiece surface is forced by gravity. The workpiece is carried on the free end of an arm pivotably supported remote from the end of the arm carrying the workpiece. Loading of the workpiece work surface can be varied by shifting weights along the length of the arm or transverse to the length of the arm. The workpiece itself can comprise a bar on which several magnetic transducing heads have been deposited. Machining the workpiece surface to a preferred position accurately defines a dimension of choice, such as the throat height of these transducers.

19 Claims, 6 Drawing Figures

Fig. 4
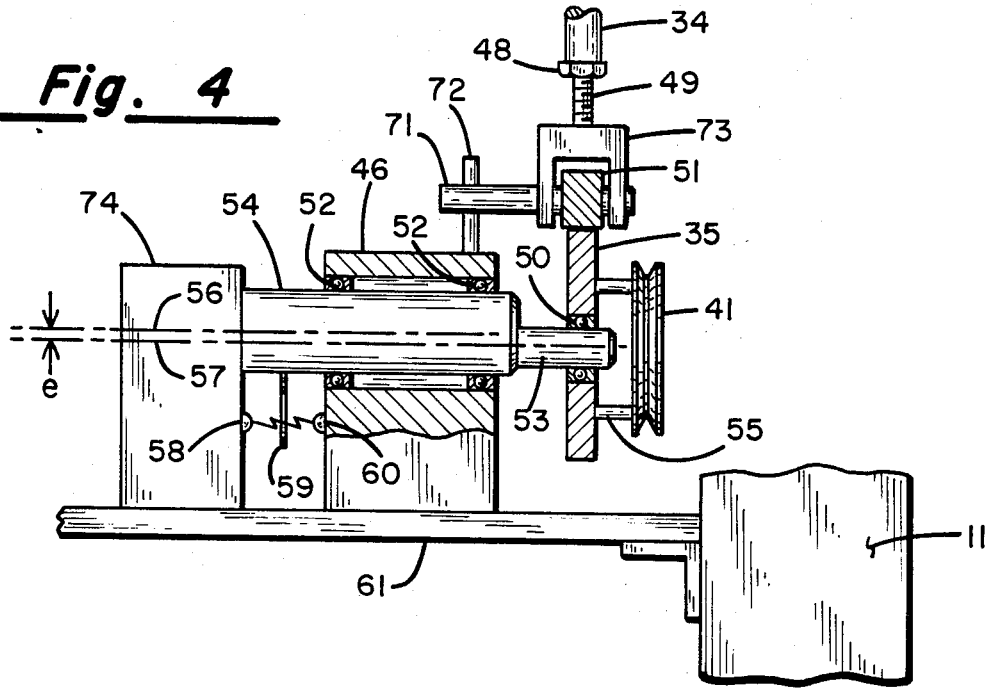
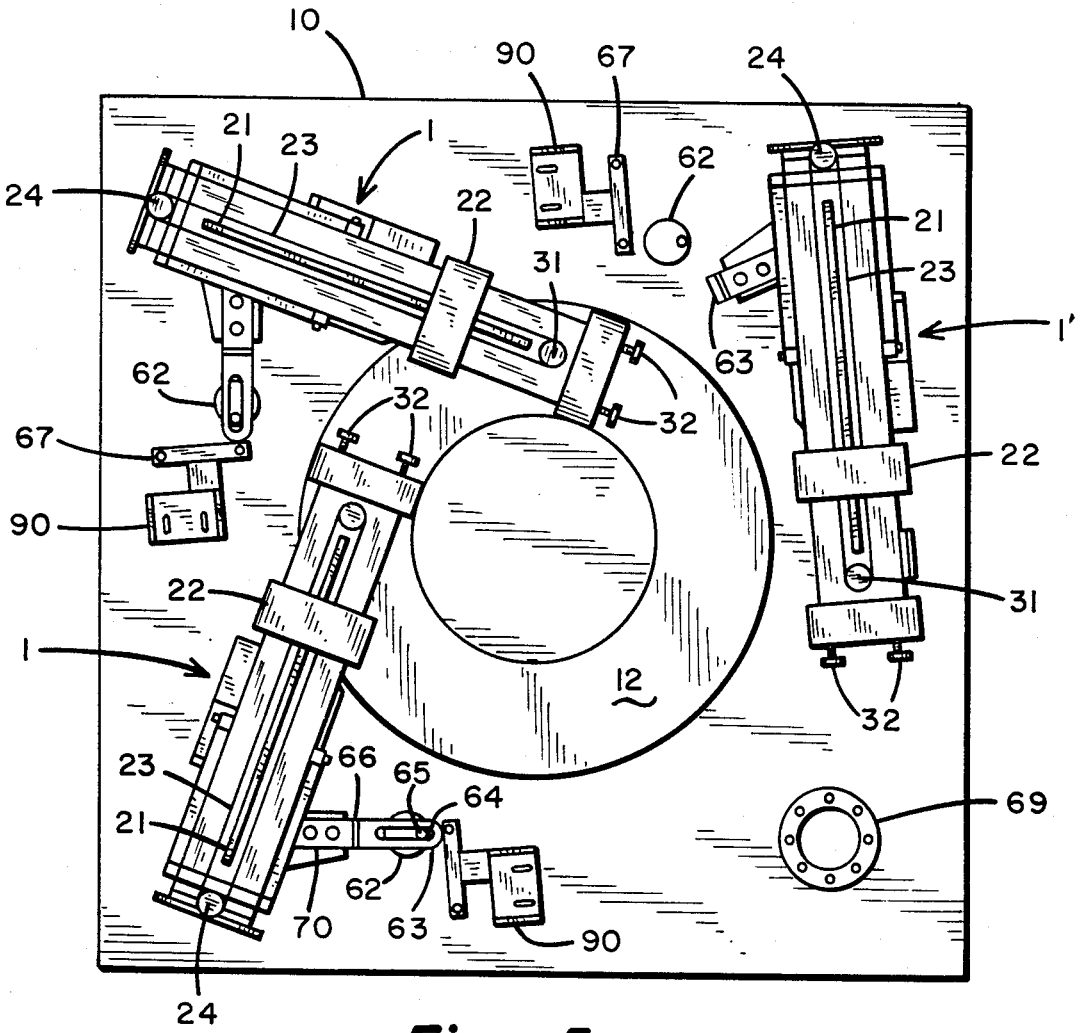
Fig. 5

PRECISION LAPPING SYSTEM

BACKGROUND OF THE INVENTION

In certain machining processes, it is desirable to very slowly (a few tens of microinches per minute at most) and at a controllable rate remove material from a flat or relatively flat workpiece work surface. One application where this capability is particularly useful is in machining a new type of magnetic transducer head employed by data recording devices, such as disk memory drives. These are known as thin-film transducers or heads.

In the past, the magnetic transducers employed by disk memory drives for writing data onto the individual disks and reading the data back therefrom have been formed with ferrite cores having small windings placed around one leg. The difficulty in producing such cores placed an effective limit on the core's size and flux gap width and length, which places limits on the width and linear bit density of the data track written. The shorter the flux path and the narrower and shorter the flux gap, the more densely can data be recorded.

Recent approaches to the fabrication of such transducers have used thin film technology to create the tranducers. Such transducers are formed of individual layers of insulating material, conductive material, and magnetic flux-conducting material created by successive deposition steps. The position and shape of features being formed of each particular material deposited is controlled by masks. Such deposition technology is old in the art, having been used in the fabrication of electronic circuitry for many years. In essence, the circuit fabrication technology employing deposition is used to create a magnetic core and a winding of the appropriate characteristics on the side of an aerodynamic slider, allowing the transducing of the data signals onto and from the disk in a disk memory. While the relative positioning and size of individual features of a single pattern being created is highly accurate, the accuracy of registration between succesive patterns employed in forming the layers comprising a complete transducer is less accurate. And the accuracy of registration of the patterns relative to a datum line on a substrate is even less accurately controllable.

When dealing with thin film heads it is necessary to control the throat height of the flux gap very accurately in order to control its magnetic characteristics. (Throat height is the dimension of the flux gap normal to the aerodynamic or flying surface of the head, and the parallel recording surface.) It is now desirable to control throat height to an accuracy of 60 microinches (1.5 microns) or less.

The use of thin film deposition techniques is substantially less costly when many patterns or elements are formed simultaneously. Therefore, it is usual to create perhaps hundreds of thin film heads simultaneously on a wafer substrate. The substrate is then sliced to create bars each having on a side a number of heads with their flux gaps aligned along one edge. This edge is formed by the intersection of the side carrying the heads with the surface aligned with the flux gaps. The surface aligned with the flux gaps forms the flying surfaces of the heads which float on a thin air bearing above the disks. (Typically, in a final step of the process, the bars will be diced into individual sliders, each having one or two transducers.)

The slicing of the substrate into these individual bars cannot be controlled with any great accuracy. Cutting these bars from the substrate cause stress changes in the bars which shift the relative positions of the transducers. Accordingly, after the individual bars have been cut from the wafer there will be small but significant on a microinch scale, variations in the throat heights of the transducers carried along the bar. Furthermore, as already mentioned, the deposition techniques have not always arranged the positions of the flux gaps of the adjacent transducers on the bar with precision relative to each other or to any datum line. Lastly, the simple process of mounting the individual bar on a carrier for machining, for example by adhesive bonding, creates stress causing additional variations in spacing from a datum.

Accordingly, it is necessary to machine the flying surfaces until the flux gap throat heights of each individual head are within the desired tolerance. To accurately control the machining of these individual sliders, it is usual to set these throat heights by machining each bar sliced from the original wafer. To aid in determining the throat heights of the individual flux gaps, so called machining sensors have been in use in conjunction with a conventional workpiece support which holds the workpiece against a lapping wheel. Output from the machining sensors is monitored until the outputs indicate that the heads, or at least the maximum possible of them, have achieved the proper throat height.

In the prior art, this machining is done in some cases by use of a workpiece holder which mechanically advances the workpiece towards the grinding surface along a preselected path. The workpiece position along that path can be controlled to permit the desired amount of material to be abraded from the workpiece. U.S. Pat. Nos. 3,110,136 (Spira), 3,921,340 (Johnson et al.), 4,014,141 (Riddle et al.), and 4,062,659 (Feierabend et al.) teach machining techniques of this type. Runout in the abrasive-carrying surface and the workpiece holder employed by these approaches makes achieving the accuracy in the 60 microinch (1.5 microns) tolerance range difficult.

In other cases, a free carrier floats on the lapping surface supported by wheels or lands and held in place by a fixed restraint. These devices do not easily allow connection of on-board machining sensors to external electronics, and the constant abrasion on the carrier requires frequent replacement of the support elements.

BRIEF DESCRIPTION OF THE INVENTION

In certain machining applications it is possible to use what we call a free arm workpiece support where gravity provides the force applying the workpiece to the machining element. These applications typically only involve removing a few thousandths of an inch from a workpiece surface whose geometry has already been fairly accurately defined. In addition, it is necessary that the workpiece surface makes stable contact with the machining element. That is, the workpiece, when attached to its support must have lateral stability, as will be explained.

This approach permits gradual and constant removal of material from the workpiece surface under the relatively constant and controllable force of gravity, rather than usual incremental jumps in the removal of material caused by mechanically controlled movement of the workpiece and the unavoidable runout in the grinding surface. In our apparatus, the machining element is an abrasive slurry carried on a flat approximately horizontal lapping surface of a large plate which is supported by a frame or bed and fixed to rotate about a vertical axis. A free carrier arm pivotably attached at one end to the frame carrying the lapping surface plate, carries the workpiece on the other end with its surface to be machined facing down and resting on the lapping surface. The arm pivot is preferably positioned on the bed to lie approximately on a perpendicular bisector of a radius of the lapping surface and the workpiece rests on the lapping surface nominally at the intersection of these two lines. Such an arrangement reduces laterally-directed friction forces on the workpiece and arm. The aforementioned lateral stability requirement causes the workpiece to maintain the desired orientation on the lapping surface. Rotation of the lapping surface can be in either direction, but lateral arm movement must be restrained if the surface adjacent the workpiece rotates toward the arm pivot. For laterally stable workpieces, it is preferable that the pivot of the arm have no less than two orthogonal axes, both being parallel to the plane of the lapping surface. The abrasive slurry on the lapping surface and the rotation of the lapping surface plate by a motor at slow speed causes the material to be slowly abraded away from the downward-facing surface of the workpiece.

The teachings of U.S. patent application No. 06/430,194, filed Sept. 30, 1982, and having common applicants and assignee with this application; and U.S. patent application No. 06/430,193, filed Sept. 30, 1982, having Kracke, Tran, and Keel as applicants and a common assignee with this application provide a preferred means for sensing the progress of the machining operation, and providing an indication of when the machining operation should stop. These two patent applications are hereby incorporated by reference into this application.

There are a number of features which it is desirable this apparatus includes in a production system. We prefer to place a weight which can be moved by a electric motor back and forth along the length of the arm. By moving the weight closer to the workpiece end, workpiece pressure is increased, and the machining rate can be altered as a function of the workpiece pressure. If one lateral side or the other of the workpiece is being machined too slowly, a second weight carried on a track transverse to the length of the arm can be shifted to that side to increase machining speed on that side. During machining, it may be useful to employ apparatus to slightly raise and/or lower the arm pivot from its nominal vertical position so as to create a non-planar workpiece surface or to increase machining speed. It is also useful to include apparatus for swinging the arm back and forth approximately along a radius of the lapping surface, so as to cause wear to occur more evenly on the surface. It may also be desirable to reverse rotation of the lapping plate during the machining of individual workpieces, or to use different directions for different processes.

It is useful to employ a workpiece carrier such as shown in U.S. patent application No. 06/430,195, filed Sept. 30, 1982, and having common applicants and assignee with this application, and which application too is incorporated by reference into the instant application. The workpiece carrier disclosed by this application is particularly useful for machining a bar-shaped workpiece on which several thin film heads have been formed. This carrier permits bending of the workpiece so as to provide for non-uniform removal of material along the length of the workpiece, thereby compensating in part for differences in position of the individual transducers from the edge of the workpiece.

The means for slightly displacing the arm pivot from its nominal vertical position allows one to create a non-planar surface on the workpiece. If done by periodic shifting of the arm pivot between two positions one can form a smoothly curved surface. If preferred, a chamfer which intersects the major plane along a well-defined line of intersection can be created by fixing the arm pivot above or below the nominal position for an appropriate period of time.

Accordingly, one purpose of this invention is to permit accurate creation of a planar surface with a desired spacing from a feature or features carried on a side intersecting the flat surface of the workpiece.

Another purpose is to create a convex surface with a preselected contour.

A third purpose is to provide a machining system which can be integrated into an automated system for control of the machining of the individual workpieces.

Another purpose of this invention is to control the rate at which material is removed from the workpiece, increasing the amount removed early in the machining process, and substantially slowing the rate of removal towards the final stages.

Yet another purpose is to vary the rate of material removal across the workpiece work surface.

Another purpose is to simplify connection of electrical conductors to machining sensors carried by a workpiece.

BRIEF DESCRIPTION OF THE DRAWINGS

FIG. 4 is a sectional view of the apparatus for controlling the vertical position of the arm pivot.

FIG. 5 is a top view of a preferred operational embodiment of the invention.

DESCRIPTION OF THE PREFERRED EMBODIMENTS

Figure 1:
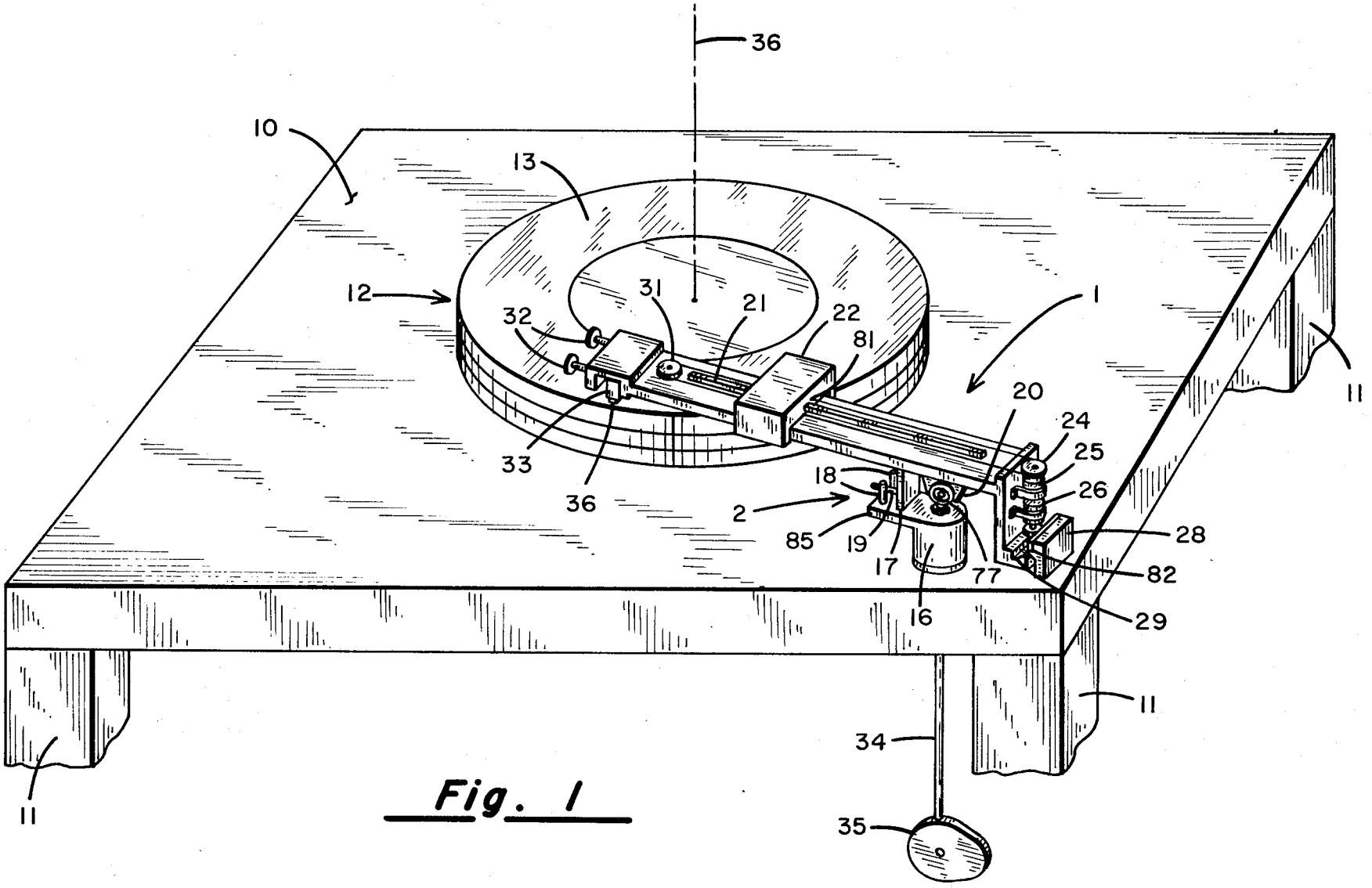
FIG. 1 is a perspective drawing of a portion of a preferred embodiment of the invention.
Figure 3:
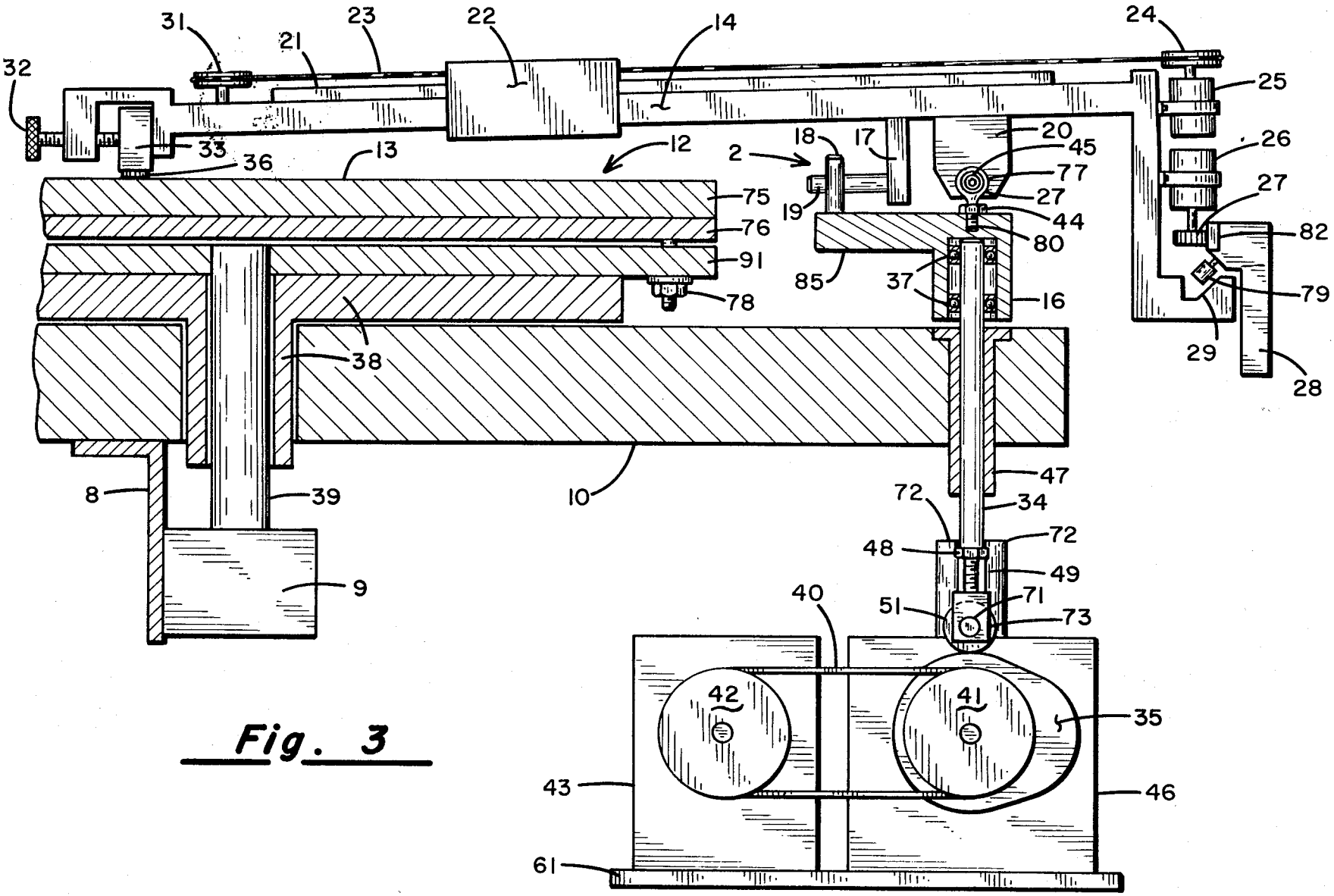
FIG. 3 is a side view of the apparatus showing certain elements in section.

FIGS. 1 and 3 show the major elements of our preferred operational embodiment. The embodiment includes a frame or bed 10 carried on legs 11 which support it at a convenient distance above the floor. A body comprising a plate or disk 12 is mounted for rotation about a vertical shaft 39 (FIG. 3) on the upper surface of frame 10 and has a flat, substantially horizontal lapping surface 13 on its upper surface. Preferably, plate 12 is supported by a highly accurate air bearing 38 (shown in sketched cross section in FIG. 3).

To allow the machined surface of a workpiece 36 to achieve nearly total flatness, it is important that vertical runout of surface 13 be kept very small. Vertical runout is dependent on the axial runout of air bearing 38, which typically is negligible, and on the flatness and perpendicularity (to the axis of bearing 38) of surface 13. Surface 13 should be machined to nearly perfect flatness.

A variable speed, reversible drive motor 9 is attached under (and to) frame 10, and connected to provide torque for rotating disk 12, either directly, or through a gear or belt drive arrangement. We prefer a motor speed range which yields a linear disk 12 speed relative to workpiece 36 of around 5 to 50 inches (12.5 to 125 cm.) per second. Disk 12 is preferably a laminated structure. A top layer 75 carrying lapping surface 13 should be made of material compatible with the abrasive system selected for use with the workpiece 36 material. For example, if the workpiece 36 is a ceramic, then top layer 75 may comprise a soft metal such as lead with diamond dust as the abrasive in an oil-based slurry carried on surface 13. Lead has little rigidity. Accordingly, a rigid backing plate 76 is solidly attached to top layer 75 to prevent distortion of surface 13 and its vertical runout as well.

Because of the desire to limit vertical runout of lapping surface 13 so far as possible, disk 12 should also have a 1eveling arrangement to position lapping surface 13 precisely perpendicular to the axis of rotation defined by bearing 38. To accomplish this, we employ three micrometer adjustments 78 (one of which is shown in FIG. 3) spaced at 120° intervals around the periphery of surface 13, and whose details are not important. Micrometer adjustments 78 are carried by a bottom disc 91, made of aluminum or other relatively stiff material, to which air bearing 38 and shaft 39 are affixed. Adjustments 78 control the orientation of lapping surface 13 with respect to air bearing 38, and should be set so that lapping surface 13 is precisely parallel to the plane in which air bearing 38 rotates.

Carrier arm assembly 1 is shown in its operating position in FIGS. 1 and 3. Arm assembly 1 is formed from a rigid material such as aluminum, and carries on it a number of individual subsystems which provide the desired capabilities for this device. Arm assembly 1 when in operating position comprises a vertically extending segment 20 pivotally supported at its lower end, a substantially horizontal segment 14 extending approximately horizontally onto lapping surface 13 and fixed to or unitary with the vertical segment 20, and a workpiece carrier element or section 33 attached rigidly to and projecting downwardly from the horizontal segment 14 at a point above the lapping surface 13 of disk 12. Workpiece 36 is attached to the bottom end of carrier element 33 and the entire assembly 1 is so balanced that the work surface of workpiece 36 faces toward and rests on lapping surface 13 with gravity-produced force. As disk 12 rotates, abrasive particles in the slurry on lapping surface 13 rub against and abrade material from the workpiece 36 surface to be machined, the attachment between workpiece 36 and its carrier 33 being strong enough to fix workpiece 36 in the specified position. The workpiece carrier 33 and the means by which workpiece 36 is attached to it form a part of the subject matter of the aforementioned U.S. patent application No. 06/430,195. For efficient operation, it is very important that carrier 33 be easily detachable from the end of the horizontal arm segment 14. The use of clamping or fastening thumbscrews 32 is one means for achieving this. Electrical attachment to the sensors carried on workpiece 36 can be easily accomplished by leading flexible wires from workpiece 36 off-arm at a convenient location.

Figure 2:
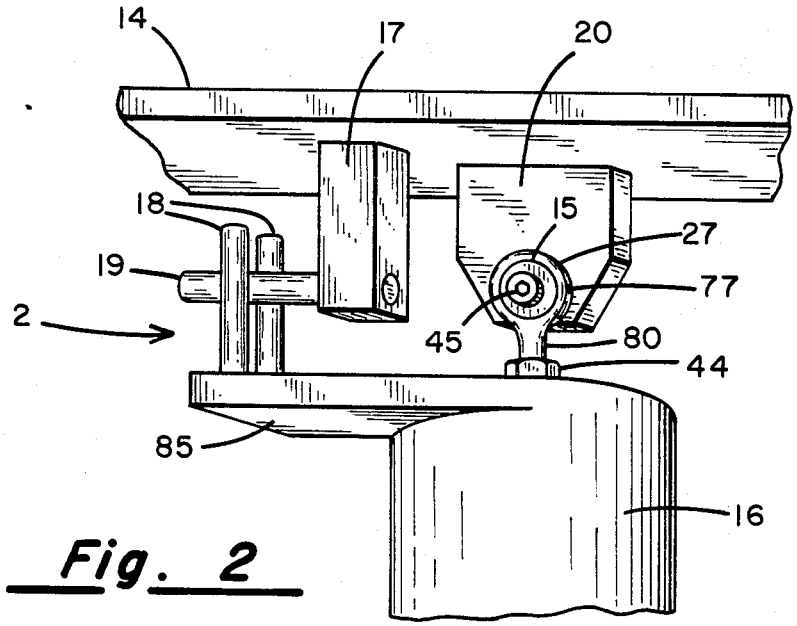
FIG. 2 is a detailed perspective of the modified universal joint attaching the arm to the bed of the apparatus.

Arm assembly 1 is supported and journaled at the lower end of its vertically extending segment 20 by a carrier arm pivot assembly 2 including a spherical bearing or universal joint 77, shown more clearly in FIG. 2. Universal joint 77 includes an upper portion comprising an internal ball 15 which freely swivels to predetermined limits about all axes within a journal 27 and is permanently entrapped therein. Joint 77 also includes a lower portion comprising a downwardly extending stem portion 80 integral with journal 27, said stem portion 80 being fixedly attached to and forming part of a carrier arm support or collar 16. We accomplish this by threading a hole at the top of support or collar 16 and turning a threaded end of stem portion 80 into this threaded hole, and locking it in position with lock nut 44. Universal joint 77 is fastened to the bottom of vertically extending segment 20 of arm assembly 1 by a cap screw 45 which passes through a hole in the center of the internal ball 15 and is threaded into the lower end of segment 20. Obviously, the attachments of ball 15 and journal 27 can be reversed.

Pivot assembly 2 in the usual case preferably allows no less than two axes of rotation (degrees of rotational freedom) for segment 20 with respect to collar 16, both in the horizontal plane. The range of rotation achieved for pivot assembly 2 for a spacing of 12 inches (0.3 meter) between itself and workpiece 36 must be in the range of at least 2°–3° for the horizontal axis transverse to arm segment 14, to allow workpiece 36 to be lifted a short distance from lapping surface 13 when replacing it. If one, for example, employed instead of universal joint 77 in a pivot assembly 2 a hinge-type joint having only one axis of rotation (degree of rotational freedom), this axis must be at least partly transverse to the length of horizontally extending segment 14, to allow lifting of workpiece 36 from surface 13 and to allow workpiece 36 to follow the small but inevitable elevation variations of lapping surface 13. The rotational freedom in joint 77 parallel to arm segment 14 allows accommodation of the work surface of workpiece 36 to make full contact with lapping surface 13. However, if the surface of workpiece 36 to be machined does not have the aforementioned lateral (with respect to the length of arm assembly 1) stability when supported by carrier 33, then no rotation of arm assembly 1 about an axis parallel to its length and relative to collar 16 is allowable. However, it is contemplated that the system here will be primarily used with workpieces whose surfaces are essentially flat and long enough laterally (respecting the long axis of assembly 1) when mounted to have the lateral stability required.

It is necessary in a system suitable for production to be able to rotate arm assembly 1 about a vertical axis through universal joint 77 an angular amount sufficient to shift workpiece 36 to the side of surface 13 for ease of attaching and detaching workpieces 36 and/or carriers 33. A typical universal joint 77 often does not have enough angular travel to conveniently permit this. It is also preferable to be able to control the position of workpiece 36 on surface 13 by setting the angular position of arm assembly 1 about the vertical axis passing through pivot assembly 2. Universal joint 77 does not 1end itself easily to such control. Accordingly, we prefer to control this angular position by controlling angular position of collar 16 and preventing rotation in universal joint 77 itself about the vertical axis.

Rotation of assembly 1 relative to collar 16 about the vertical axis is constrained by another element of pivot assembly 2 comprising a vertical bracket 17 fixed to and extending downwardly from arm segment 14 and from which extends horizontally a pin 19, having a circular cross-section. The axis of pin 19 passes precisely through the center of rotation of universal joint 77, a relationship maintained regardless of the orientation of arm assembly 1 because pin 19 is fixed in position relative to the entire arm assembly 1. A pair of pins 18 extend vertically upward from a horizontal bracket 85 rigidly attached to collar 16 and extend to straddle pin 19 whenever arm assembly 1 is in normal position. Pins 19 are spaced parallel from each other to form a vertical, parallel-sided slot of width very slightly greater than but substantially equal to the diameter of pin 19. As shown in both FIGS. 1 and 2, pins 18 and 19 are arranged so that pin 19 passes between pins 18 and is straddled by them. Horizontal clearance between pin 19 and pins 18 is small enough to prevent almost all relative rotation about the vertical axis between collar 16 and arm assembly 1 and allows the angular position of collar 16 to control the position of assembly 1, and thus also the position of workpiece 36 on surface 13. Since the axis of pin 19 passes precisely through the center of rotation of universal joint 77, rotation of arm assembly 1 about the axis of pin 19 is possible to the limits of travel of universal joint 77.

Collar 16 is supported by vertical shaft 34, about which it can rotate by virtue of a pivot formed by ball bearings 37 within collar 16 and shown in FIG. 3. This permits assembly 1 to be swung to one side of disk 12 by rotation on bearings 37 for convenience in attachment and removal of workpiece carrier 33. By adjusting the vertical elevation of shaft 34, and rotating collar 16 relative to shaft 34, various useful capabilities to be explained later, are available.

The nominal or home elevation of pivot assembly 2 preferably places its axes in the plane of lapping surface 13, although any convenient predetermined home elevation is possible if the various carrier arm assembly 1 dimensions are such that workpiece 36 makes the desired contact with surface 13. In the typical situation, workpiece 36 initially has a flat work surface and a flat surface parallel to it which is bonded to the bottom surface of carrier 33. The major portion of the work surface is typically intended to be perfectly flat and substantially parallel to its original orientation upon completion of machining. Thus, the work surface should be oriented during machining with full surface contact by the work surface on lapping surface 13. This can be achieved by properly selecting the vertical lengths of carrier 33 and vertically extending segment 20 and the vertical position of pivot assembly 2 as well as the angular orientation of "horizontally" extending segment 14. (The quotation marks are to acknowledge that a non-horizontal orientation for segment 14 is possible, depending on the relative vertical lengths of carrier 33, workpiece 36, and segment 20.)

There are several advantages, however, in selecting the nominal or home elevation of pivot assembly 2 axes to be in the plane of lapping surface 13. Alignment is simpler since the reference is well-defined. Thermal expansion or contraction of carrier 33 and segment 20 operate over the same length of structure and hence tend to cancel each other out. Backlash movement in pivot assembly 2 due to friction between the lapping surface 13 and workpiece 36 is all horizontal, and hence does not affect angular position of workpiece 36 on surface 13. Torque on collar 16 to shift the position of workpiece 36 on surface 13 does not create reactive loads on workpiece 36 transferring loading and changing cutting speed from one side to the other, when pivot assembly 2 axes are in the plane of surface 13. All these reasons make it advantageous to align the axes of pivot assembly 2 with the plane of lapping surface 13 during the machining operation. During the remainder of this description we will assume this definition of home or nominal elevation. Home elevation is also the elevation at which the axes of pivot assembly 2 are positioned when the work surface of a chosen workpiece 36 is making full surface contact with surface 13.

During the major portions of a typical machining operation, pivot assembly 2 will be parked at its home elevation since this will ensure full surface contact of the work surface on lapping surface 13. However, it may sometimes be desirable to create a convex work surface having either a smoothly curved profile or two or more well defined plane surfaces or chamfers. This system can create such profiles by shifting the axes of pivot assembly 2 vertically from its home elevation. For example a chamfer on the work surface of workpiece 36 is necessary when workpiece 36 is one which will eventually be diced into a number of a certain type of thin film head. This particular chamfer should have a sharp line of intersection with the other, and major, flat area of the work surface. Such a chamfer can be easily created on an edge of workpiece 36 by raising or lowering pivot assembly 2 with respect to its nominal position by an amount which creates the desired chamfer angle on workpiece 36 along the desired edge. The length of time which machining occurs with workpiece 36 in the attitude defined by such shifting of pivot assembly 2 from the nominal controls the chamfer surface length. If desired, a chamfer can be blended into the main work surface, or the entire work surface curved, by periodically raising and lowering pivot assembly 2 in an appropriate manner.

The shifting of the elevation of pivot assembly 2 is accomplished by raising or lowering support shaft 34 through rotation of cam 35 (FIGS. 1, 3 and 4) by a camming system mounted on sub-base 61. It is convenient to attach sub-base 61 to an adjacent leg 11. Support shaft 34 is sized to slide freely within the bore of cylinder 47 (FIG. 3). Cylinder 47 is fixed in bed 10 with its bore vertical. Shaft 34, as explained earlier, is attached by bearings 37 to collar 16 so that collar 16 can freely rotate about the axis of shaft 34 but cannot translate in relation thereto. A hole in the lower end of shaft 34 is threaded to receive a threaded shaft 49 which in turn is attached to a cam follower comprising bracket 73, a shaft 71 which passes through it, and a roller 51 which is journaled on shaft 71. Roller 51 is supported by and follows cam 35, which in turn supports all the apparatus mounted on shaft 34. Cam 35 is shown in FIG. 3 in its home position, half way between predetermined high and low points on its profile which places pivot assembly 2 at its home elevation. (The high and low points are exaggerated for clarity.) Threaded shaft 49 and its associated locknut 48 serve merely to adjust the position of pivot assembly 2 relative to the center of shaft 71. Thus, as top layer 75 of disk 12 slowly wears during use or if top layer 75 is remachined, this adjustment allows repositioning pivot assembly 2 to precisely coincide vertically with the plane of lapping surface 13 when cam 35 is in its home position.

To prevent rotation of shaft 34, shaft 71 extends (FIGS. 3 and 4) to pass between pins 72 mounted on pillow block 46, thereby maintaining the axis of roller 51 nearly parallel at all times with the axis of cam 35. Cam 35 is in turn supported on stub shaft 53 by bearing 50 and is free to rotate thereon. Pulley 41 is rigidly attached to cam 35 by brackets 55 and is concentric with stub shaft 53. Stub shaft 53 is carried by main shaft 54 which in turn is supported by pillow block 46 through bearings 52. Pillow block 46 is supported by sub-base 61. Motor 43 carries pulley 42 on its shaft and can drive pulley 41 through belt 40 to any desired position. Motor 43 is one of the type whose shaft can be accurately stopped in any desired position.

To create the simple chamfered work surface shape needed in the previously described application, cam 35 is rotated by motor 43 from the angular orientation parking pivot assembly 2 at the elevation forming one plane, to the angular orientation which parks pivot assembly 2 at the elevation allowing the second plane to be formed. Motor 43 carries pulley 42 on its output shaft, which is connected to drive pulley 41 with a belt 40. Rotation of motor 43 a suitable fraction of a revolution causes cam 35 to shift from its home position toward a lobe or antilobe and cause shaft 34 to shift either upwardly or downwardly between predetermined limits. It is preferred that motor 43 be a stepper motor whose angular shaft position can be controlled by the input power signal so as to create a functional relationship between the input power signal to motor 43 and the position of shaft 34, so that elevation of pivot assembly 2 can be accurately controlled with respect to the plane of lapping surface 13. The weight of arm assembly 1 is sufficient to keep roller 51 firmly in contact with cam 35 when in normal operation.

Another purpose for displacing the axis of pivot assembly 2 from the plane of surface 13 is, during initial stages of a machining operation, to allow a relatively large amount of the abrasive material on surface 13 to enter the area between the surface of workpiece 36 being machined and lapping surface 13, thereby increasing machining speed. This can be accomplished by periodically displacing the axis of pivot assembly 2 above and below the plane of lapping surface 13. To accomplish this, a second electric motor 74 is also mounted on subbase 61 with its output shaft driving main shaft 54. Main shaft 54 has mounted eccentrically on it a stub shaft 53 on which cam 35 is mounted. As stated above, shaft 54 is journaled on bearings 52 within pillow block 46, which is also mounted on subbase 61. In FIG. 4 stub shaft 53 is shown mounted on shaft 54 with its center line 57 displaced from the center line of shaft 54 by a predetermined eccentricity distance e. Accordingly, as motor 74 rotates, shaft 53 will traverse a vertical distance 2e for each rotation of motor 74, causing the axis of pivot assembly 2 to also shift vertically by this amount and periodically form a small gap at the leading edge (relative to rotation of plate 12) of workpiece 36 allowing abrasive to enter the machining interface and increase the speed at which material is removed from workpiece 36. If the work surface of workpiece 36 is to be finally planar, then pivot assembly 2 is fixed in its home position for a time to permit the workpiece surface to be ground flat. e should have a value sufficient to allow the abrasive particles to enter the space between the work surface and lapping surface 13, and thus depends on abrasive particle size and length of horizontally extending segment 14.

To reliably return pivot assembly 2 to its home elevation, there is provided a photocell arrangement 58 and 60 which senses the position of a finger 59 fixed to shaft 54. Motor 74 is always stopped with finger 59 interrupting the light beam between the photocell elements 58 and 60, so as to position stub shaft 53 in precisely the same position for final lapping of workpiece 36.

In the machining of bars from which thin film head sliders will be formed and in other machining operations as well, where the work surface is to be finally located relative a feature on the edge of the workpiece, relatively high material removal speeds are preferred during the early portions of the machining operation, and slower material removal speeds are preferred as the work surface nears its preferred location. Furthermore, certain workpieces 36 machine more slowly than others. In addition to cyclic vertical movement of pivot assembly 2 induced by rotation of shaft 54 to hasten material removal, it is also useful to place the appropriate amount of pressure on the work surface of workpiece 36 early in the machining operation to create high machining speeds. Accordingly, there is provided a weight 22 (FIGS. 1, 3 and 5) which is movable along a predetermined longitudinal path on the top of horizontal arm segment 14 from a position nearly above carrier arm pivot assembly 2 to a position relatively close to the free end of segment 14 and adjacent workpiece carrier 33. Weight 22 is constrained to travel along this path by a rail 21 running longitudinally on and attached to or integral with the top of arm segment 14 and which mates with a slot or notch of weight 22. Weight 22 is driven along this predetermined path on segment 14 by weight shifting means shown in FIG. 3 including a reversible motor 25 attached near the pivoted end of arm assembly 1. Direction of motor 25 rotation depends on the input power it receives. A pulley or sprocket 24 is mounted on the shaft of motor 25 which in turn drives a belt or chain 23 which is attached at point 81 to weight 22 and is maintained in tension along the length of arm segment 14 by passing around an idler pulley 31 attached near the free end of arm segment 14. By providing power to motor 25 to cause it to rotate in a first direction, weight 22 can be caused to move in a first direction on arm segment 14 and be parked at any desired position along the path. Applying a different input power to motor 25 reverses the direction of rotation of pulley 24 and changes the direction of movement of weight 22 to reach any desired position available by such movement. Properly positioning weight 22 on arm segment 14 allows control of pressure on workpiece 36 and changes machining speed. One should note that excessive pressure on workpiece 36 actually reduces cutting speed as well as potentially causing undesirable heating of workpiece 36.

It is also useful to change the pressure distribution in the radial direction across the workpiece 36 (i.e. transverse to horizontal arm segment 14), so as to in a controlled fashion make the rate at which material is removed from its work surface different from one end to the other. One important motivation for this is simply that the differing linear velocities of lapping surface 13 causes faster machining at the outboard end of workpiece 36 adjacent the larger radii than inboard. Secondly, in those operations where the final work surface position is to be spaced within a preselected tolerance from a set of features carried on the side of workpiece 36, and these features aren't perfectly aligned, the ability to vary the amount of material removed from one end or the other of the work surface may allow more of the features to finally fall within the tolerance range.

We prefer to change the pressure distribution along the work surface in the radial direction by shifting on arm assembly 1 along a predetermined lateral (with respect to arm segment 14) path a weight 28 supported by wheels or other support element 79, see FIGS. 1 and 3. Weight 28 engages a rail or track 29 mounted transverse to and on arm segment 14 and adjacent pivot assembly 2 and the pivoted end of arm assembly 1. A reversible motor 26 similar to motor 25 is mounted adjacent weight 28 and carries on its shaft a pinion 27 engaging a rack 82 mounted on and extending transversely (relative to arm segment 14) from one side of weight 28 to the other, thereby comprising a means for shifting weight 28 along track 29 and parking it at any desired position thereon. As motor 26 rotates in one or the other direction in response to its input power, weight 28 is shifted to one or the other side of the rail 29, changing the pressure distribution along workpiece 36 between it and lapping surface 13. The ability of carrier arm pivot assembly 2 to rotate very slightly about an axis parallel to the length of arm segment 14 is important to allow this. Accordingly, the rate at which material is removed from one or the other end of workpiece 36 can be differentially controlled by simply applying the proper input power to motor 26. This is particularly useful when means are employed for frequently monitoring the spacing between the workpiece 36 work surface and features on a side of workpiece 36 intersecting the work surface. Such features may be magnetic head throats and the spacing monitored by using the sensors disclosed in the aforementioned U.S. patent application Nos. 06/430,194 and 06/430,193. Proper control of weight 28 position can result in a final work surface position maximizing the number of such features falling within the spacing tolerance. Obviously, if workpiece 36 does not have the lateral stability discussed earlier, this capability has no use.

Figure 6:
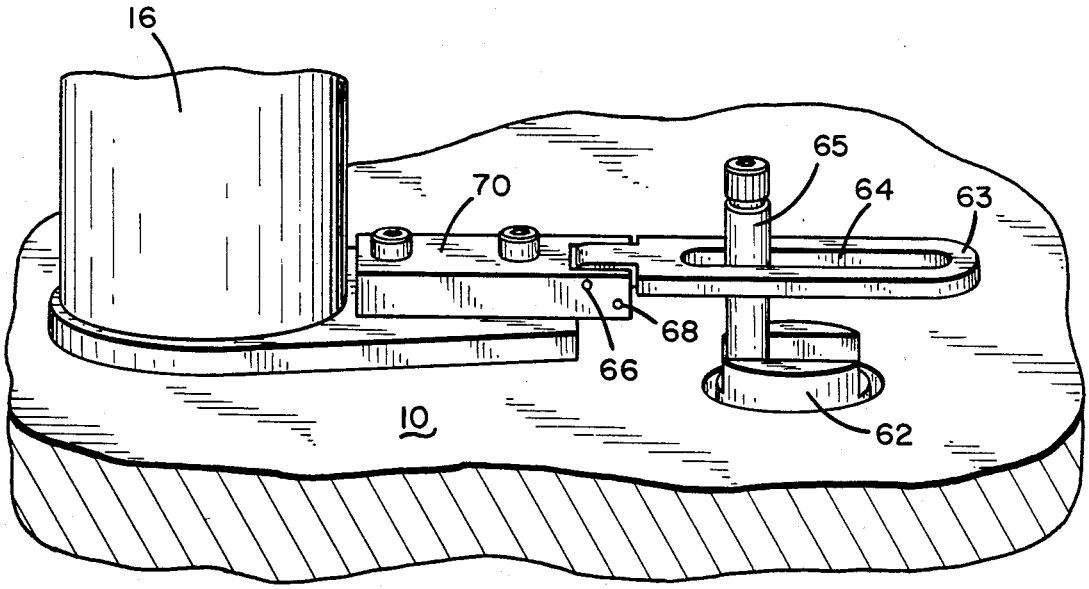
FIG. 6 is a detailed perspective of the mechanism for controlling radial position of the workpiece on the lapping surface.

Referring next to FIGS. 5 and 6, therein is shown a means for causing workpiece 36 to shift back and forth radially across the area of lapping surface 13 and to positively maintain the position of workpiece 36 thereon. This is desirable to maintain the flatness of surface 13 necessary to accurately form a flat work surface on the workpiece 36 and also to allow machining to occur with plate 12 rotating toward joint 77. A bracket 70 is rigidly fastened to carrier arm support collar 16. A slotted arm 63 is hinged at one end by horizontal pin 66 to bracket 70 allowing arm 63 to rotate about a horizontal axis between a raised position and the horizontal position shown in FIG. 6. The walls of slot 64 in arm 63 are designed to enclose a pin 65 eccentrically attached to shaft 62, thereby forming a Scotch yoke. Shaft 62 is mounted in bed 10 for rotation, and is driven by a small electric motor (not shown) mounted beneath bed 10. Pin 68 (FIG. 6) is a stop for arm 63 rotation so that it is maintained approximately horizontal and spaced somewhat above shaft 62. When its motor generates torque, shaft 62 is caused to rotate and the pin 65 applies force to arm 63 tangent to the axis of collar 16 causing collar 16 to oscillate between preselected angular positions on bearings 37. Workpiece 36 then periodically shifts back and forth radially between the outer and inner edges of the area containing the abrasive slurry on lapping surface 13, insuring that wear is relatively evenly distributed radially across it. Arm 63 is hinged with pin 66 to bracket 70 so that when arm 63 is raised to an approximately vertical position, arm assembly 1 can be swung, again on bearings 37, to a docking position at one side of lapping surface 13.

FIG. 5 shows a top view of an operational embodiment with three arm assemblies 1 and 1' attached to bed 10. Assembly 1' is shown in its docked position. A fourth assembly 1 may also be attached at holes 69 with their own below frame apparatus, as previously described, with all four assemblies 1 being essentially identical and all sharing plate 12 for machining their respective workpieces. Of course, depending on the size of plate 12, more or less than four assemblies may share a single plate.

In a production device, it is useful to employ a lifting mechanism, not shown, carried by collar 16 for squarely setting workpiece 36 onto and for squarely lifting it from surface 13. One reason is to provide a simple means of halting the lapping operation. Another is to prevent workpiece 36 from landing on or lifting from surface 13 unevenly, thereby possibly damaging either workpiece 36 or surface 13. FIG. 5 also shows a docking structure 90 including a carrier support 67 on which a workpiece carrier 33 may rest when it is being installed. This minimizes the likelihood that it will be accidentally dropped, since considerable dexterity is otherwise required to manually hold a carrier 33 in position in a free-swinging arm assembly 1 while operating the clamping screws 32.

It is possible to employ machining sensors to directly signal the progress of the various machining steps to an operator who can then adjust the various control elements to achieve the desired dimensions. Unless machining proceeds at a relatively slow rate, however, four individual arm assemblies 1 may prove to be too much for a single operator to manage effectively. Thus, one may rather wish to incorporate this apparatus into a computer controlled system, including sensors providing signals indicating status of the various elements controlling the vertical position of pivot assembly 2, and positions of weights 22 and 28. It is preferred when using this system in this manner to employ machining sensors such as have already been described in the aforementioned U.S. patent application Nos. 06/430,193 and 06/430,194. If the aforementioned arm-lifting mechanism is incorporated, it too may be placed under computer control and lapping of a workpiece terminated at the appropriate time simply by causing the mechanism to lift the arm.

It is clear that many different embodiments are possible within the spirit of this invention, all of which we wish to protect by the following claims.

What is claimed is:

1. Apparatus for machining a workpiece surface, said surface having initial lateral stability, comprising:

a. a substantially rigid frame;

b. a lapping body having a substantially flat lapping surface carrying thereon abrasive particles within a predetermined area, and mounted on the frame for rotation about a vertical axis with the lapping surface substantially horizontal;

c. a motor mounted on the frame and operatively connected to the body to provide torque for rotating the body;

d. a carrier arm support attached to the frame;

e. a rigid carrier arm assembly attached to the carrier arm support by a carrier arm pivot having a horizontal axis of rotation extending generally toward the predetermined area of the lapping body and lying within a predetermined distance of the plane of the lapping surface, said carrier arm assembly having a generally vertically extending segment journaled at the pivot, a segment extending generally horizontally toward the predetermined area of the lapping surface and along the carrier arm pivot's horizontal axis of rotation, and fixed to the upper end of the vertically extending segment, and a workpiece carrier attached to the horizontally extending segment at a point above and extending downwardly toward the lapping surface; and f. means cooperating with the carrier arm support and the carrier arm pivot for allowing the workpiece carrier vertical movement above the lapping surface, wherein the workpiece carrier element includes a workpiece attachment means for fixing the workpiece with the surface to be machined facing downwardly toward and resting with gravity pressure on the lapping surface and within the circles traced by the inner and outer peripheries of the abrasive-carrying area.

2. The apparatus of claim 1, wherein the carrier arm assembly includes a first weight movable along a predetermined path on the arm and means for shifting the weight along the path and parking the weight at any of a plurality of positions along the path.

3. The apparatus of claim 2, wherein the predetermined path extends longitudinally along the horizontally extending arm segment.

4. The apparatus of claim 1, wherein the means allowing vertical workpiece carrier movement includes within the carrier arm pivot a universal joint having orthogonal axes of rotation approximately parallel to the plane of the lapping surface.

5. The apparatus of claim 4, wherein the carrier arm assembly includes a first weight movable along a predetermined path on the arm and means for shifting the weight along the path and parking the weight at any of a plurality of positions along the path.

6. The apparatus of claim 4, wherein the carrier arm assembly further comprises a second weight, means for supporting the weight and allowing it to move transverse to the horizontal arm segment along a predetermined path, and means carried by the carrier arm assembly for parking the second weight at any of a plurality of positions on the predetermined path.

7. The apparatus of claim 6, wherein the weight supporting means comprises a track transversely attached to the carrier arm assembly, and a support element on the weight and engaging the track.

8. The apparatus of claim 1, wherein the carrier arm pivot comprises a universal joint whose center of rotation lies approximately in the plane of the lapping surface and comprises a ball and a journal in which the ball is entrapped and can freely swivel about all axes.

9. The apparatus of claim 8, wherein the carrier arm support further comprises a collar mounted for rotation on the frame, to which is attached one of the ball and journal, the other of the ball and journal being attached to the carrier arm assembly, and further comprising a bracket attached to the carrier arm assembly and including a pin of circular cross-section whose axis passes through the center of rotation of the universal joint, and a bracket attached to the collar and having a vertical slot of width substantially equal to the pin diameter, and through which the pin projects.

10. The apparatus of claim 9, further comprising means fixed to the frame and operatively connected to the carrier arm support, for periodically rotating the carrier arm support between preselected angular positions whereby the workpiece is periodically shifted back and forth radially between the outer and inner edges of the predetermined area of abrasive particles on the lapping surface.

11. The apparatus of claim 10, wherein the carrier arm support rotating means further comprises an arm attached to the carrier arm support by a hinge and a torque generating means carried on the frame and engaged by the hinged arm by rotating the hinged arm on its hinge, said torque generating member applying force to the hinged member thereby causing rotation of the carrier arm support.

12. The apparatus of claim 4, wherein the carrier arm support further comprises a shaft mounted on the frame for vertical translation; means mounted on the frame for shifting the vertical position of the shaft, and a collar mounted at the top end of the shaft and rotatable about a vertical axis with respect to the frame; and wherein the universal joint includes upper and lower portions universally pivotable with respect to each other, said universal joint lower portion being fixed to the collar and said universal joint upper portion being fixed to the vertically extending segment of the carrier arm assembly.

13. The apparatus of claim 12, wherein the carrier arm pivot includes means fixed to the collar and the carrier arm assembly for restraining rotation of the universal joint elements with respect to each other about the vertical axis.

14. The apparatus of claim 12, wherein the shaft-shifting means comprise a cam mounted for rotation on the frame and positioned to be followed by the shaft.

15. The apparatus of claim 12, wherein the shaft-shifting means includes means for parking the shaft in the position placing the center of rotation of the universal joint approximately in the plane of the lapping surface.

16. The apparatus of claim 4, wherein the carrier arm support includes means for shifting the carrier arm pivot vertically within the predetermined distance from the plane of the lapping surface.

17. The apparatus of claim 14, wherein the carrier arm pivot includes means for periodically displacing the carrier arm pivot from the plane of the lapping surface, and resetting the carrier arm pivot axis in the plane of the lapping surface within a predetermined time interval.

18. The apparatus of claim 4, wherein the carrier arm support includes means for automatically shifting the carrier arm pivot vertically within the predetermined distance from the plane of the lapping surface, while the lapping body rotates.

19. The apparatus of claim 1, wherein the workpiece surface rests on a radius of the lapping surface extending from the lapping body vertical axis which is approximately perpendicular to the length of the carrier arm assembly horizontal segment.

* * * * *